US012612677B2

(12) United States Patent
Miura et al.

(10) Patent No.: US 12,612,677 B2
(45) Date of Patent: Apr. 28, 2026

(54) EQUIPMENT AND METHOD FOR LEACHING COPPER, AND METHOD FOR PRODUCING ELECTROLYTIC COPPER USING SAID EQUIPMENT AND METHOD

(71) Applicant: JX NIPPON MINING & METALS CORPORATION, Tokyo (JP)

(72) Inventors: Akira Miura, Hitachi (JP); Ronny Winarko, Vancouver (CA); Wenying Liu, Vancouver (CA)

(73) Assignee: JX ADVANCED METALS CORPORATION, Tokyo (JP)

( * ) Notice: Subject to any disclaimer, the term of this patent is extended or adjusted under 35 U.S.C. 154(b) by 612 days.

(21) Appl. No.: 17/919,912

(22) PCT Filed: Apr. 20, 2021

(86) PCT No.: PCT/JP2021/016081
§ 371 (c)(1),
(2) Date: Oct. 19, 2022

(87) PCT Pub. No.: WO2021/215449
PCT Pub. Date: Oct. 28, 2021

(65) Prior Publication Data
US 2023/0235426 A1 Jul. 27, 2023

(30) Foreign Application Priority Data
Apr. 20, 2020 (JP) ..... 2020-075000

(51) Int. Cl.
*C22B 3/02* (2006.01)
*C22B 3/08* (2006.01)
*C22B 15/00* (2006.01)

(52) U.S. Cl.
CPC ..... *C22B 3/02* (2013.01); *C22B 3/08* (2013.01); *C22B 15/0071* (2013.01)

(58) Field of Classification Search
CPC ..... C22B 3/02; C22B 3/08; C22B 15/0071; C22B 3/26; C22B 15/0069; C22B 3/18
(Continued)

(56) References Cited

U.S. PATENT DOCUMENTS 6,833,021 B1 * 12/2004 Hourn ..... C22B 3/12 423/28
10,550,450 B2 * 2/2020 Kawashiro ..... C22B 3/04
2013/0239752 A1 9/2013 Sato et al.
2013/0287654 A1 * 10/2013 Yamada ..... H01M 10/052 252/186.1
(Continued)

FOREIGN PATENT DOCUMENTS

AU 2014245389 B2 10/2014
EP 0124213 * 7/1984 ..... C22B 11/04
(Continued)

OTHER PUBLICATIONS

JP2015078414, Miura et al. , Method Of Exuding Copper From Copper Sulfide Ore, Apr. 23, 2015 (Year: 2015).*
(Continued)

*Primary Examiner* — Jessee R Roe
*Assistant Examiner* — Michael Aboagye
(74) *Attorney, Agent, or Firm* — Birch, Stewart, Kolasch & Birch, LLP

(57) ABSTRACT

Provided is a method for efficiently promoting a leaching reaction of copper. Equipment for leaching copper includes a reactor for leaching reaction and a controller for oxidation-reduction potential. The reactor is configured to be provided with a leaching solution containing iodine and iron. The reactor is configured to be capable of being tightly sealed during the leaching reaction. The controller for oxidation-reduction potential is configured so that, during the leaching reaction, the oxidation-reduction potential of the leaching solution can be maintained at 500 mV (based on Ag/AgCl reference) or higher.

10 Claims, 3 Drawing Sheets

(58) Field of Classification Search
USPC ..... 266/168, 101, 114; 75/744, 740, 711, 75/741
See application file for complete search history.

(56) References Cited

U.S. PATENT DOCUMENTS

| | | | | |
|---|---|---|---|---|
| 2014/0206056 | A1* | 7/2014 | Hazewinkel | C02F 3/286 435/167 |
| 2018/0002781 | A1 | 1/2018 | Kawashiro et al. | |
| 2020/0048736 | A1 | 2/2020 | Dixon et al. | |
| 2024/0167121 | A1* | 5/2024 | Dixon | C22B 15/0071 |

FOREIGN PATENT DOCUMENTS

| | | | | | |
|---|---|---|---|---|---|
| JP | 2011-84757 | A | | 4/2011 | |
| JP | 2013-155416 | A | | 8/2013 | |
| JP | 2013-189687 | A | | 9/2013 | |
| JP | 2015-78414 | A | | 4/2015 | |
| JP | 2015078414 | | * | 4/2015 | Y02P 10/20 |
| JP | 2016-169425 | A | | 9/2016 | |
| JP | 2019-178406 | A | | 10/2019 | |
| JP | 2021-25977 | A | | 2/2021 | |

OTHER PUBLICATIONS

International Search Report for PCT/JP2021/016081 mailed on Jul. 20, 2021.

International Preliminary Report on Patentability and English translation of the Written Opinion of the International Searching Authority (Forms PCT/IB/338, PCT/IB/373, and PCT/ISA/237) for International Application No. PCT/JP2021/016081, dated Nov. 3, 2022.

* cited by examiner

EQUIPMENT AND METHOD FOR LEACHING COPPER, AND METHOD FOR PRODUCING ELECTROLYTIC COPPER USING SAID EQUIPMENT AND METHOD

FIELD OF THE INVENTION

The present invention relates to equipment and a method for leaching copper and a method for producing electrolytic copper using said equipment and method.

BACKGROUND OF THE INVENTION

Copper ore can be classified into oxide ore, secondary copper sulfide ore, primary copper sulfide ore, etc. Copper contained in oxide ore can be easily leached under acid conditions. Copper contained in secondary copper sulfide ore can be leached by ferric leaching, etc. In contrast, copper contained in primary copper sulfide ore is known to be hard to be leached. However, primary copper sulfide ore accounts for a large amount of copper ore. Thus, it would be beneficial if it were possible to leach copper from primary copper sulfide. Patent Literature 1 discloses a method for recovering copper from primary copper sulfide, specifically, the method of leaching by a solution containing iodide ions and Fe (III) ions.

Patent Literature 2 discloses that a leaching solution contains iodine molecules, iodide ions and/or iodic acid ions and further contains nitric acid ions and nitrous acid ions. Furthermore, Patent Literature 2 discloses that the status for almost all of Fe ions in a leaching solution is desirably Fe ions (Ill). As for Fe ions, Patent Literature 2 discloses that leaching reaction proceeds preferably if oxidation-reduction potential based on standard hydrogen electrode (SHE) reference in a leaching solution at 25 degrees C. is above 710 mV.

Moreover, as for iodine contained in a solution of leaching, Patent Literature 3 discloses that oxidation-reduction potential in a post-leaching solution should be controlled to 450 mV or less (based on Ag/AgCl reference) for the purpose of reducing loss of iodine due to volatilization of iodine.

PRIOR ART

Patent Literature

[Patent Literature 1] Japanese Patent Application Publication No. 2013-189687

[Patent Literature 2] Japanese Patent Application Publication No. 2015-078414

[Patent Literature 3] Japanese Patent Application Publication No. 2016-169425

SUMMARY OF THE INVENTION

Although Patent Literature 1 discloses the reaction system utilizing a solution of leaching containing iodide ions and Fe ions (III), it is silent about oxidation-reduction potential. Although Patent Literature 2 discloses oxidation-reduction potential, it discloses the reaction system of a solution of leaching which is added with nitric acid ions and nitrous acid ions to be utilized. Thus, the reaction system disclosed in Patent Literature 2 is different from the reaction system, as disclosed in Patent Literature 1, which utilizes a solution of leaching containing iodide ions and Fe ions (III). Patent Literature 3 discloses an invention of which purpose is to reduce loss of iodine due to volatilization of iodine after leaching reaction (i.e., in a post-leaching solution), and it is silent about loss of iodine due to volatilization of iodine during leaching reaction.

In view of the above, an object of the present invention is to provide better conditions for a method of leaching utilizing iodide ions and Fe ions (III) during leaching reaction, thereby providing an effective method of leaching copper.

In light of the above object, the present inventors have studied intensively and found the possibility that leaching reaction preferably proceeds if adjusting oxidation-reduction potential to a certain value or more. However, in practice, a high value of oxidation-reduction potential resulted in significant loss of iodine due to volatilization of iodine, and thus leaching reaction did not improve as expected. Then, the present inventors have tried sealing a reactor resulting in reducing loss of iodine due to volatilization of iodine. Then, the present inventors have found that the leaching reaction proceeded preferably.

On the basis of the above discovery, in one aspect, the present invention includes the following inventions.

[1] Equipment for leaching copper, the equipment comprising a reactor for leaching reaction and a controller for oxidation-reduction potential, the reactor being configured to be provided with a leaching solution containing iodine and iron and being configured to be capable of being tightly sealed during the leaching reaction, the controller for oxidation-reduction potential being configured so that, during the leaching reaction, the oxidation-reduction potential of the leaching solution can be maintained at 500 mV (based on Ag/AgCl reference) or higher.

[2] The equipment of invention 1, the equipment further comprising a pH controller, the pH controller being configured so that pH of the leaching solution can be controlled within a range from 1.0 to 2.0.

[3] The equipment of invention 1 or 2, the reactor comprising a lid that is made from PTFE.

[4] The method for leaching copper with use of the equipment of any one of inventions 1-3, the method comprising:

- introducing a substance containing copper and a leaching solution into the reactor; and
- proceeding the leaching reaction
- wherein the proceeding the leaching reaction includes proceeding the leaching reaction while the reactor is tightly sealed, and
- wherein the proceeding the leaching reaction includes maintaining oxidation-reduction potential of the leaching solution at 500 mV (based on Ag/AgCl reference) or higher.

[5] The method of invention 4, wherein the proceeding the leaching reaction includes proceeding the leaching reaction under conditions of pH within a range from 1.0 to 2.0.

[6] The method of producing electrolytic copper, the method comprising performing the method of invention 4 or 5.

According to an aspect of the present invention, the reactor is configured to be sealable during the leaching reaction. Further, the controller for oxidation-reduction potential is configured so that, during the leaching reaction, oxidation-reduction potential of the leaching solution can be maintained at 500 mV (based on Ag/AgCl reference) or higher. Due to these configurations, the leaching reaction proceeds preferably.

DETAILED DESCRIPTION OF THE INVENTION

Figure 1:
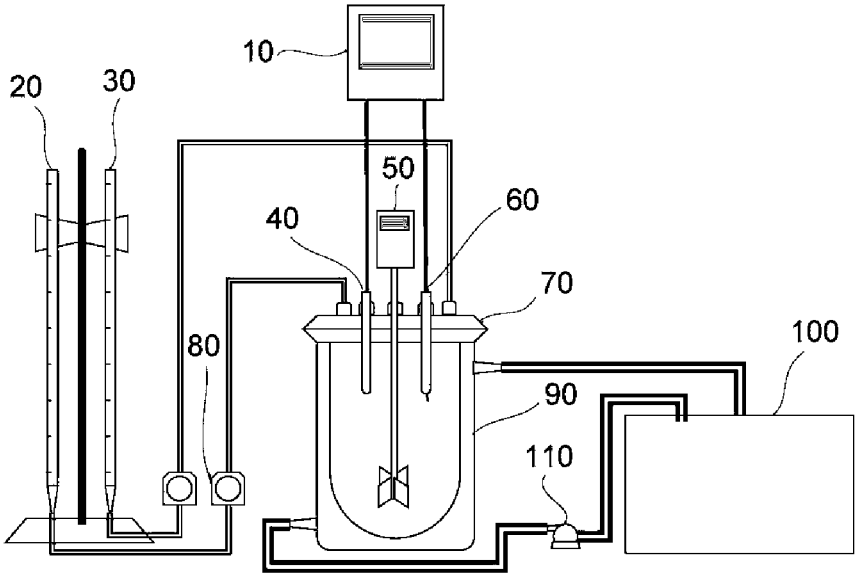
FIG. 1 shows equipment for leaching copper according to one embodiment of the present invention.

More specified embodiments to practice the present invention are described hereinafter, which are not intended to limit the scope of the present invention, but are for the purpose of enhancing the understanding of the present invention.

1. Leaching Reaction that the Present Invention can be Applied to

In one embodiment, the present invention relates to equipment and method for leaching copper. Copper can be leached from ore containing copper. The term "ore" as used herein includes not only ore as raw materials, but also includes concentrate. Concentrate can be obtained by grinding stones as raw materials and/or by ore dressing (e.g., froth flotation).

Ore containing copper includes oxide ore, secondary copper sulfide ore, primary copper sulfide ore, etc. Examples of primary copper sulfide ore include, for example, bornite, chalcopyrite, etc. Equipment and method for leaching copper according to one embodiment of the present invention are preferable for chalcopyrite.

A leaching solution for leaching copper contains iodine (e.g., iodide ions) and iron (e.g., Fe ions (III)). These chemical elements react with a copper compound in ore to ionize copper and to cause leaching into the solution (a detail for reaction is described hereinafter).

The source of iron may be compounds such as iron sulfate n-hydrate ($Fe_2(SO_4)_3 \cdot nH_2O$). Alternatively, a solution of divalent iron ions (e.g., Iron (II) sulfide) may be supplied and then it may be converted to trivalent iron ions by Iron-oxidizing bacteria, etc.

The source of iodine may be an arbitrary form. For example, it may be supplemented in the form of elemental iodine molecule (which can be solubilized and converted into iodide ions), iodide (e.g., potassium iodide), etc.

Although the concentration of iodine in a leaching solution (i.e., the total concentration of iodine which includes any forms of iodine such as molecular iodine ($I_2$), iodide ion ($I^-$), triiodide ion ($I_3^-$), and the like) is not particularly limited, it may be at least 50 mg/L or more, preferably 100 mg/L or more, more preferably 150 mg/L or more. Although the upper limit is not particularly limited, it may be typically 300 mg/L or less.

Although the concentration of iron in a leaching solution (i.e., the total concentration of iron which includes any forms of iodine such as Fe ions (II), Fe ions (III), and the like) is not particularly limited, it may be at least 1 g/L or more, preferably 2 g/L or more, more preferably 5 g/L or more. Although the upper limit is not particularly limited, it may be typically 10 g/L or less.

A leaching solution may contain any ingredients other than iodine and iron. For example, as a result of adjusting oxidation-reduction potential described hereinafter, a leaching solution may contain oxidizing agent and/or reducing agents, and furthermore, it may contain a resultant substance caused from their reaction. In another example, as a result of adjusting pH described hereinafter, a leaching solution may contain $H^+$ ions, $OH^-$ ions, and/or their counterions.

In equipment and methods according to one embodiment of the present invention, there is no need to add, to a leaching solution, nitric acid ions and nitrous acid ions as shown in Patent Literature 2, etc.

Hereinafter, referring to chalcopyrite as an example, equipment and methods for leaching copper are described.

2. Equipment for Leaching Copper from Copper Ore

FIG. 1 shows conceptual equipment for leaching copper. Equipment includes at least a reactor 90 for leaching reaction and a controller 10 for oxidation-reduction potential (ORP).

(2-1. Reactor for Leaching Reaction)

A reactor for leaching reaction is a place where copper leaching reaction occurs. As shown in an example according to FIG. 1, the reactor 90 may include a jacket. Furthermore, the reactor 90 may have a sealable structure to prevent gas from flowing into and out of the reactor 90 during leaching reaction. Thereby, loss of iodine due to volatilization of iodine may be prevented. In addition, a material for the reactor 90 is preferably glass, or a material of glass lining (which is covered by glass material), or PTFE (Poly Tetra Fluoro Ethylene) in view of sealability and reactivity with iodine. The reactor 90 may include the lid 70 in its upper side to achieve sealability. As similar to a material for the reactor 90, a material for the lid 70 is preferably glass, or a material of glass lining (which is covered by glass material), or PTFE, and especially a material for parts of lid 70 that contact with the reactor 90 is preferably PTFE.

The reactor 90 is configured to be supplied with a leaching solution containing iodine and iron. Iodine and iron may be converted into an arbitrary form due to leaching reaction described hereinafter, etc. For example, iodine may be converted into the forms of iodine molecules ($I_2$), iodide ions ($I^-$), triiodide ions ($I_3^-$), etc. Iron may be converted into the forms of Fe ions (II), Fe ions (III), etc.

Although not shown in Figures, equipment may include a member of supplying a leaching solution to provide a leaching solution to the reactor 90. Although specified structure for the member of supplying a leaching solution is not particularly limited, it may include, for example, a pipe and a tank to provide a leaching solution, and optionally, a controller for control of supplying a leaching solution.

In order to agitate a leaching solution inside the reactor 90, equipment may include agitating equipment 50. A material for impeller parts in the agitating equipment 50 is preferably PTFE. In addition to this, in order to adjust an amount of liquid, etc., equipment may include a water bath 100 and a pump 110 for supplying liquid.

(2-2. Controller for Oxidation-Reduction Potential)

The controller 10 for oxidation-reduction potential (ORP) adjusts oxidation-reduction potential in a leaching solution during leaching reaction. For the purpose of this, equipment may have the ORP electrode 60 and the tank for oxidizing agent 20. The controller for oxidation-reduction potential may control an amount of oxidizing agent supplied from the tank 20 for oxidizing agent on the basis of oxidation-reduction potential of a leaching solution that has been determined by the ORP electrode. Although the controller 10 for oxidation-reduction potential (ORP) may control oxidation-reduction potential to an arbitrary value, in order to promote a good copper leaching reaction, the value of oxidation-reduction potential is maintained to 500 mV (based on Ag/AgCl reference) or higher. The value of oxidation-reduction potential is preferably 520 mV or higher, and more preferably 540 mV or higher. The upper limit may be, though not particularly limited, typically 700 mV or less.

(2-3. Controller for pH)

In addition to the reactor 90 for leaching reaction, and the controller 10 for oxidation-reduction potential, etc., equipment may further include a controller 10 for pH. The controller 10 for pH adjusts pH in a leaching solution during leaching reaction. For the purpose of this, equipment may include the pH electrode 40 and the tank 30 for pH adjuster. The controller 10 of pH may control an amount of pH adjuster supplied from the tank 30 for pH adjuster on the basis of pH of a leaching solution that has been determined by the pH electrode 40. Preferably, the tank 30 for pH adjuster may accommodate an acidic pH adjuster and a basic pH adjuster. Although the controller 10 for pH may control pH to an arbitrary value, in order to promote a good copper leaching reaction, the value of pH is preferably controlled within a range from 1.0 to 2.0, more preferably, from 1.3 to 1.7. The controller 10 for pH may exist separately from the above-stated controller for the oxidation-reduction potential, alternatively, the controller 10 for pH may be integrated with the above-stated controller for oxidation-reduction potential as shown in FIG. 1.

3. Method for Leaching Copper from Copper Ore

Utilizing the above-stated equipment, copper can be leached. More specifically, the method for leaching copper includes the following steps.

introducing a substance containing copper and a leaching solution into a reactor; and proceeding leaching reaction.

A detail for each of the steps is described hereinafter.

(3-1. Step of Introducing a Substance Containing Copper and a Leaching Solution into a Reactor)

As stated above, equipment includes the reactor 90 for leaching reaction. A substance containing copper and a leaching solution are introduced into the reactor 90. The substance containing copper may be ore containing copper as stated above. The leaching solution contains iodine and iron as stated above.

(3-2. Step of Proceeding Leaching Reaction)

Although the following description is not intended to limit the scope of the present invention, leaching proceeds for example, according to a series of the catalytic reaction by iodine as shown in the following Formula I and Formula II.

$$2I^- + 2Fe^{3+} \rightarrow I_2 + 2Fe^{2+} \quad \text{(Formula I)}$$

$$CuFeS_2 + I_2 + 2Fe^{3+} \rightarrow Cu^{2+} + 3Fe^{2+} + 2S + 2I^- \quad \text{(Formula II)}$$

Furthermore, in the reaction of Formula II, copper sulfide ore is oxidized by Fe (III) ions and by iodine ($I_2$) which is generated via the reaction of Formula I to generate copper ions ($Cu^{2+}$). In addition, the above triiodide ions ($I_3^-$) also contribute to the reaction of Formula II as a catalyst as similar to iodine ($I_2$).

The step of proceeding leaching reaction includes sealing the reactor 90 for proceeding leaching reaction. For example, after introducing the substance containing copper and the leaching solution, the lid 70 may be mounted on the reactor 90 to seal the reactor 90.

The step of proceeding leaching reaction includes maintaining oxidation-reduction potential of the leaching solution at 500 mV (based on Ag/AgCl reference) or higher. By maintaining oxidation-reduction potential of the leaching solution at 500 mV (based on Ag/AgCl reference) or higher, triiodide ion ($I_3^-$), which contributes as a catalyst during leaching, can stably exist, and as a result, an amount of leaching increases. The value of oxidation-reduction potential is preferably 520 mV or higher, and more preferably 540 mV or higher. The upper limit may be, though not particularly limited, typically 700 mV or less.

When maintaining oxidation-reduction potential, oxidizing agent can be used. Although not particularly limited, oxidizing agent to be used may be, for example, potassium permanganate, etc.

The step of proceeding leaching reaction may include proceeding leaching reaction at pH within a range from 1.0 to 2.0. By maintaining the range, leaching reaction can proceed preferably and an amount of triiodide ion ($I_3^-$), which contributes as a catalyst during leaching, increases. A range of pH is more preferably from 1.3 to 1.7.

A type of pH adjuster is not particularly limited and a typical type of pH adjuster in the art may be used. For example, an acidic pH adjuster may include sulfuric acid ($H_2SO_4$), chloric acid (HCl), etc. For example, a basic pH adjuster may include sodium hydroxide (NaOH), potassium hydroxide (KOH), etc.

Temperature for proceeding leaching reaction is also not particularly limited and may be ambient temperature or more (e.g., 25 degrees C. or more), 30 degrees C. or more, or 35 degrees C. or more. In general, reaction proceeds better at the higher temperature. Although the upper limit is not particularly limited, it is typically 60 degrees C. or less because reaction in proportion to high temperature reaches a plateau.

Time for leaching reaction is also not particularly limited and may be 168 hours or more, or 336 hours or more. Although the upper limit is not particularly limited, it is typically 514 hours or less because reaction for a too long time reaches a plateau.

An important point for proceeding leaching reaction preferably is that while the reactor 90 is sealed, oxidation-reduction potential in a leaching solution is maintained to a certain value or more. As stated above, an increase of oxidation-reduction potential in a leaching solution theoretically leads to preferable proceed of a leaching reaction, but in practice, iodine volatilizes and its amount decreases with time. With a decrease of the amount of iodine, the rate of leaching reaction decreases. However, sealing the reactor 90 prevents iodine from volatilizing. Thus, a decrease of the rate of leaching reaction due to iodine volatilization can be prevented.

4. Method of Producing Electrolytic Copper

In one embodiment, the present invention relates to a method of producing electrolytic copper. The method may include at least performing the above-stated steps. Via these steps, a post-leaching solution of copper can be obtained. From the obtained post-leaching solution, copper ions can be selectively recovered and concentrated by Solvent Extraction (SX). Then, from the concentrated copper solution, electrolytic copper can be produced by Electrowinning (EW).

EXAMPLES

Hereinafter, via the following working examples, the above-described embodiments of the present invention are described more specifically, although the scope of the present invention is not limited to the following working examples.

5. Example 1 (Oxidation-Reduction Potential)

Next, the relation between oxidation-reduction potential and the rate of Cu extraction was examined. One liter of an aqua acidic solution of sulfuric acid and 2 grams of copper concentrate which primarily contains chalcopyrite were introduced into a reactor. The concentration of iron in the aqua acidic solution of sulfuric acid was 5 g/L. The source of iron was iron(II) sulfate (Fe(II)) and iron(III) sulfate (Fe(III)). Incidentally, the amounts of these sources of iron to be added were set as shown in Table 1 for the purpose of setting desired oxidation-reduction potential.

TABLE 1

| oxidation-reduction potential (mV vs Ag/AgCl) | $Fe^{3+}$ (g/L) | $Fe^{2+}$ (g/L) |
|---|---|---|
| 570 | 4.900 | 0.100 |
| 545 | 4.750 | 0.250 |
| 526 | 4.500 | 0.500 |
| 515 | 4.286 | 0.714 |
| 505 | 4.000 | 1.000 |
| 470 | 2.500 | 2.500 |

The concentration of iodine in the aqua acidic solution of sulfuric acid was 150 mg/L. The pH of the solution was controlled to 1.5 with use of sulfuric acid. The temperature was maintained at 25 degrees C. Samples were taken with an amount of about 3 mL from the reactor and were subjected to a filter with a 0.2-micrometer pore size, and the concentration of copper in the solution was analyzed by ICP-OES (SPS7700, SEIKO inc). Potassium permanganate was used for controlling oxidation-reduction potential (ORP).

Figure 2:
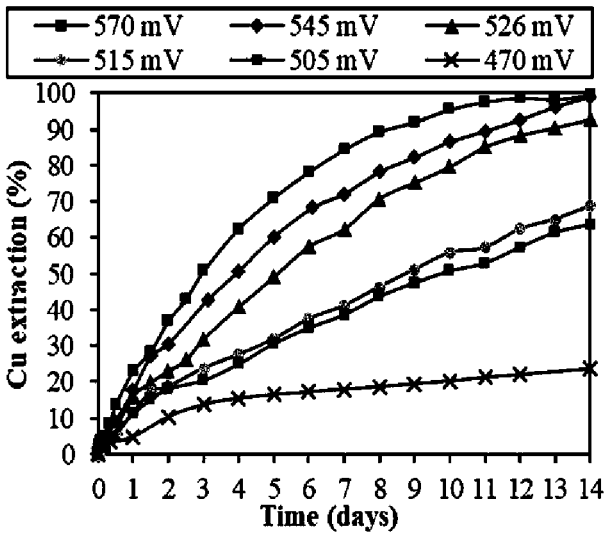
FIG. 2 shows the relation between oxidation-reduction potential and the rate of Cu extraction in one embodiment of the present invention. The vertical axis indicates the rate of Cu extraction, and the horizontal axis indicates days of leaching reaction.

The change of the rate of Cu extraction with the change of controlled ORP from 470 mV to 570 mV was determined. The result is shown in FIG. 2. When oxidation-reduction potential was controlled to 470 mV, the rate of Cu extraction was 20%. However, when oxidation-reduction potential was controlled to 500 mV or more, the rate of Cu extraction was above 50%. Further, when oxidation-reduction potential was controlled to 526 mV or more, the rate of Cu extraction was above 90%.

6. Comparative Example

Figure 3:
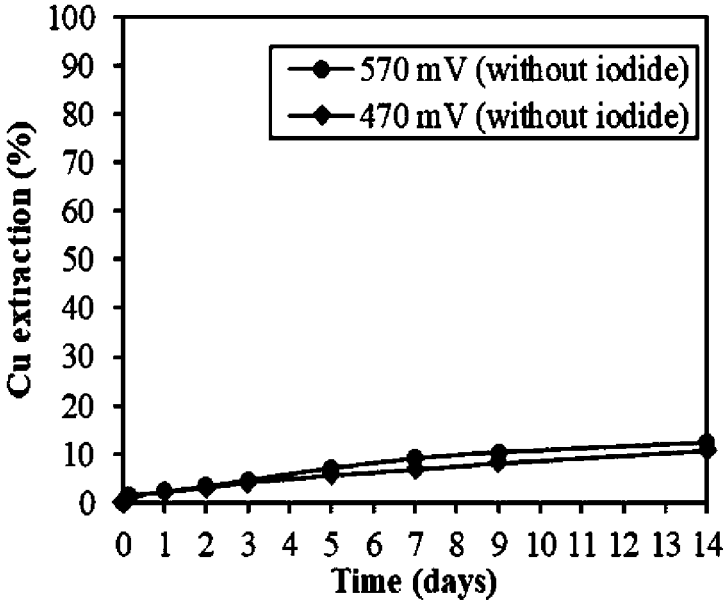
FIG. 3 shows the relation between oxidation-reduction potential and the rate of Cu extraction in the case without iodine as a comparative example. The vertical axis indicates the rate of Cu extraction, and the horizontal axis indicates days of leaching reaction.

Iodine was not added and ORP to be controlled was set to two values (470 mV and 570 mV). The other conditions were the same as those of Example 2. The result is shown in FIG. 3. In any oxidation-reduction potential, the rate of Cu extraction was 10%.

7. Example 2 (the Concentration of Iodine)

Figure 4:
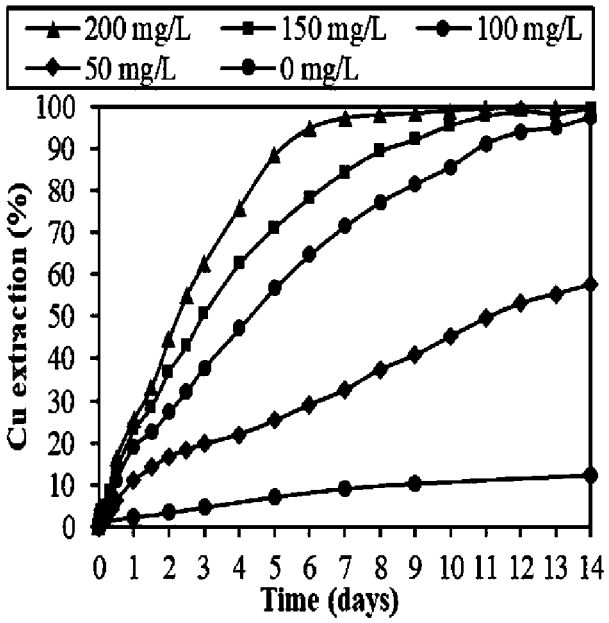
FIG. 4 shows the relation between the concentration of iodine and the rate of Cu extraction in one embodiment of the present invention. The vertical axis indicates the rate of Cu extraction, and the horizontal axis indicates days of leaching reaction.

The concentration of iodine was changed in a range from 0 to 200 mg/L. ORP was controlled to 570 mV. The other conditions were the same as those of Example 1. The result is shown in FIG. 4. At the concentration of 100 mg/L or more, the rate of Cu extraction was nearly 100%.

8. Example 3 (Temperature)

Figure 5:
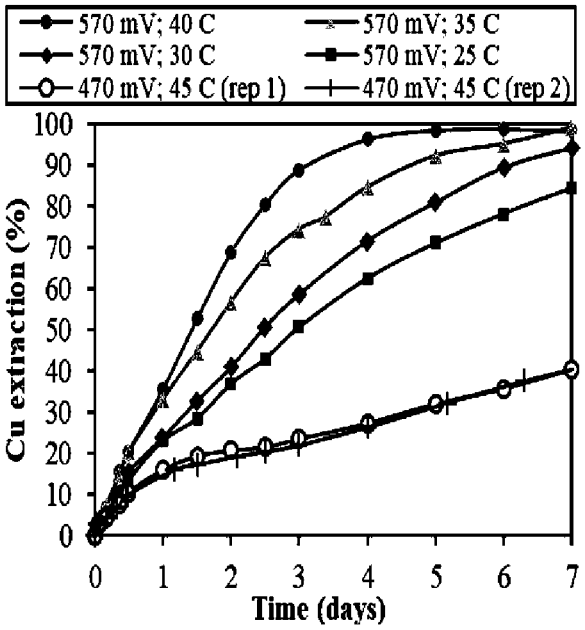
FIG. 5 shows the relation between the temperature and the rate of Cu extraction in one embodiment of the present invention. The vertical axis indicates the rate of Cu extraction, and the horizontal axis indicates days of leaching reaction.

The concentration of iodine was set to 150 mg/L. ORP to be controlled was set to two values (470 mV and 570 mV). The temperature was changed within a range from 25 degrees C. to 45 degrees C. The other conditions were the same as those of Example 1. The result is shown in FIG. 5. In the case where ORP was 570 mV, the higher temperature promoted better Cu leaching. In the case where ORP was 470 mV, even if the temperature was set to 45 degrees C., the rate of Cu extraction was only 40%.

9. Supplementary Example (Oxidation-Reduction Potential and Ionic Forms of Iodine)

Figure 6:
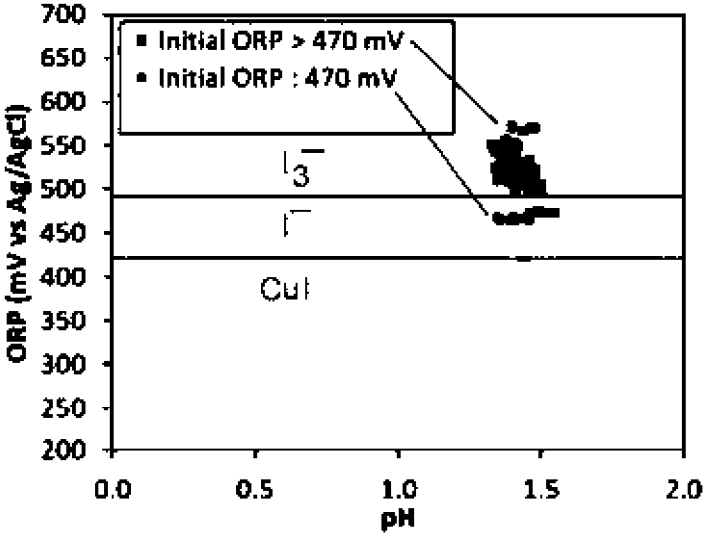
FIG. 6 shows the relation between pH and potential, in particular, the relation between pH (horizontal axis) and oxidation-reduction potential (vertical axis) and status of iodine. In the figure, the values for the resultant pH and ORP in the reactor that have been examined in Example 1 are plotted to be shown.

FIG. 6 shows the status of iodine in a solution when oxidation-reduction potential and pH change. In this figure, the values for potential and pH in the reactor determined in Example 2 were plotted.

Approximately at pH 1.5, when oxidation-reduction potential was above 500 mV, the form of ions was triiodide ion ($I_3^-$), from which the reaction according to the above-stated Formula II was assumed to be promoted under co-existence with chalcopyrite.

The detailed embodiments of the present invention have been described. The above embodiments are merely an example of the present invention, and the present invention is not limited to the above embodiments. For example, a technical feature disclosed in one embodiment may be applied to another embodiment. Furthermore, regarding a method or process, the order of some steps may be switched from other steps unless otherwise noted. Also, a further step may be inserted among certain two steps. The scope of the present invention is defined by the appended claim.

DESCRIPTION OF REFERENCE NUMERALS

10 Controller for pH and ORP
20 Tank for oxidizing agent
30 Tank for pH adjuster
40 pH electrode
50 agitating equipment and mixing impeller
60 ORP electrode
70 Lid
80 Metering pump
90 Reactor
100 Water bath
110 Pump for supplying liquid

The invention claimed is:

1. Equipment for leaching copper, the equipment comprising a reactor for a leaching reaction and an oxidation-reduction potential controller, the reactor being configured to be provided with a leaching solution containing iodine and iron and being configured to be capable of being tightly sealed during the leaching reaction, the oxidation-reduction potential controller configured to control an oxidation-reduction potential of the leaching solution during the leaching reaction to 500 mV or higher, based on Ag/AgCl reference, by controlling an amount of oxidizing agent supplied to the reactor, wherein the leaching solution consists of a source of iron, a source of iodine, and optionally an oxidizing agent and/or a pH adjuster, wherein the source of iron is one or more chemicals selected from the group consisting of iron sulfate n-hydrate ($Fe_2(SO_4)_3 \cdot nH_2O$), iron (II) sulfate and iron (III) sulfate, wherein the source of iodine is one or more chemicals selected from the group consisting of elemental iodine molecule, and iodide, wherein the oxidizing agent is potassium permanganate, and wherein the pH adjuster is one or more chemicals selected from the group consisting of sulfuric acid ($H_2SO_4$), chloric acid (HCl), sodium hydroxide (NaOH), and potassium hydroxide (KOH).

2. The equipment of claim 1, the equipment further comprising a pH controller, the pH controller being configured so that pH of the leaching solution can be controlled within a range from 1.0 to 2.0.

3. The equipment of claim 1, the reactor comprising a lid that is made from PTFE.

4. The equipment of claim 2, the reactor comprising a lid that is made from PTFE.

5. The equipment of claim 1, wherein the oxidation-reduction potential controller is configured to control the oxidation-reduction potential of the leaching solution during the leaching reaction to 540 mV or higher, based on Ag/AgCl reference, by controlling the amount of oxidizing agent supplied to the reactor.

6. A method for leaching copper with use of the equipment of claim 1, the method comprising:

introducing a substance containing copper and the leaching solution into the reactor; and proceeding the leaching reaction wherein the proceeding the leaching reaction includes proceeding the leaching reaction while the reactor is tightly sealed, and wherein the proceeding the leaching reaction includes maintaining the oxidation-reduction potential of the leaching solution at 500 mV or higher, based on Ag/AgCl reference.

7. The method of claim 6, wherein the proceeding the leaching reaction includes proceeding the leaching reaction under conditions of pH within a range from 1.0 to 2.0.

8. A method for leaching copper with use of the equipment of claim 2, the method comprising:

introducing a substance containing copper and the leaching solution into the reactor; and proceeding the leaching reaction wherein the proceeding the leaching reaction includes proceeding the leaching reaction while the reactor is tightly sealed, and wherein the proceeding the leaching reaction includes maintaining the oxidation-reduction potential of the leaching solution at 500 mV or higher, based on Ag/AgCl reference.

9. A method for leaching copper with use of the equipment of claim 3, the method comprising:

introducing a substance containing copper and the leaching solution into the reactor; and proceeding the leaching reaction wherein the proceeding the leaching reaction includes proceeding the leaching reaction while the reactor is tightly sealed, and wherein the proceeding the leaching reaction includes maintaining the oxidation-reduction potential of the leaching solution at 500 mV or higher, based on Ag/AgCl reference.

10. A method for leaching copper with use of the equipment of claim 4, the method comprising:

introducing a substance containing copper and the leaching solution into the reactor; and proceeding the leaching reaction wherein the proceeding the leaching reaction includes proceeding the leaching reaction while the reactor is tightly sealed, and wherein the proceeding the leaching reaction includes maintaining the oxidation-reduction potential of the leaching solution at 500 mV or higher, based on Ag/AgCl reference.

* * * * *